US005483454A

United States Patent [19]

Lewiner et al.

[11] Patent Number: 5,483,454

[45] Date of Patent: Jan. 9, 1996

[54] PORTABLE APPLIANCES FOR INFORMING BUS USERS

[75] Inventors: Jacques Lewiner, Saint-Cloud; Eric Carreel, Paris, both of France

[73] Assignee: Jean-Claude Decaux, Neuilly Sur Seine, France

[21] Appl. No.: 235,320

[22] Filed: Apr. 29, 1994

[30] Foreign Application Priority Data

Apr. 30, 1993 [FR] France ..... 93 05164

[51] Int. Cl.[6] ..... G08G 1/123

[52] U.S. Cl. ..... 364/443; 364/569; 340/994

[58] Field of Search ..... 364/443, 436, 364/569; 340/988, 991, 992, 993, 994, 996

[56] References Cited

U.S. PATENT DOCUMENTS 4,713,661 12/1987 Boone et al. ..... 340/994
4,791,571 12/1988 Takahashi et al. ..... 340/994
4,799,162 1/1989 Shinkawa et al. ..... 340/994

FOREIGN PATENT DOCUMENTS 0451756 10/1991 European Pat. Off. .
93/13510 7/1993 WIPO .
94/02923 2/1994 WIPO .
94/02922 2/1994 WIPO .

*Primary Examiner*—Gary Chin
*Attorney, Agent, or Firm*—Larson and Taylor

[57] ABSTRACT

A portable appliance (1) is provided for informing the users of a bus network about waiting times for buses at various stops of the network. Simple depressions of keys (3, 4, 5) cause appropriate displays to appear on a screen (2) of the appliance, enable a plurality of bus driving distances approaching respective predetermined stops of the network to be stored, and simply pressing on a button (6 or 7) makes it possible to cause any stored driving distance to be selectively displayed on said screen, together with visible information concerning the waiting times for buses at the stop approached by the final driving distance.

8 Claims, 3 Drawing Sheets

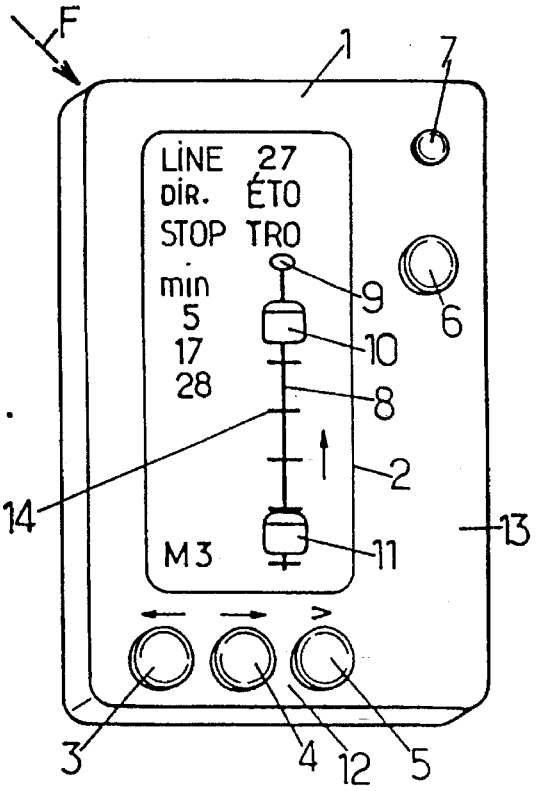
FIG.1.
FIG.2.
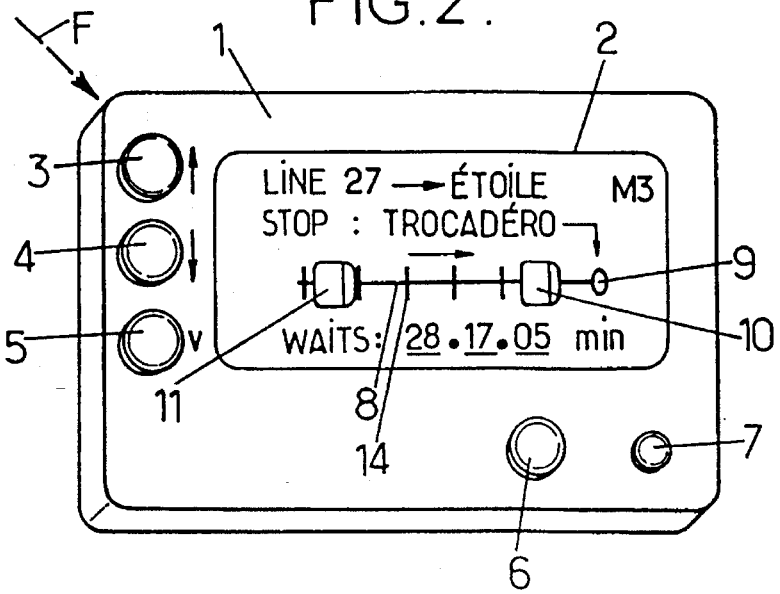

PORTABLE APPLIANCES FOR INFORMING BUS USERS

BACKGROUND OF THE INVENTION

1. Field of the Invention

The invention relates to portable appliances for informing users of urban bus networks about waiting times for buses at various stops in such networks.

2. The Prior Art

Amongst such appliances, the present invention relates more particularly to those that are suitable for cooperating with an installation designed to generate and transmit signals, preferably cyclically and over an electromagnetic path, which signals provide information about the respective instantaneous real positions of the buses of the network. The appliance includes an electrical power supply, user-actuatable interrogation means suitable for identifying any specified stop of the network, means suitable for receiving the above-mentioned signals and for selecting those of said signals which relate at least to the "next bus" expected at the identified stop, and means including a video screen suitable for displaying on said screen information associated with the waiting time for the next bus at said stop.

Such portable appliances have been described, for example, in the Applicant's French patent No. 92 09042.

In the embodiments of such appliances that are described more particularly in that patent, each display on the appliance concerning waiting times for next buses expected at a given stop requires the user to actuate a plurality of keys included in a keypad for the purpose of identifying the line in the network that includes the stop under consideration, the travel direction of the bus along said line, and the stop itself.

SUMMARY OF THE INVENTION

An object of the invention is to simplify the use of appliances of the kind in question, in particular by subdividing the displays into two periods: a "prior programming" period that may be performed under periods of calm outside conditions when the appliance is in use; and a "working" period, i.e. a period during which the display is of use, which working period is very simple to control, generally by pressing on a single button, without there being any need for the user to input new data into the appliance.

To this end, according to the invention, a portable appliance is provided which comprises;

firstly, programing means including memory means suitable for storing a first list with respect to the various lines of the network together with their destinations, a plurality of second lists with respect to the various stops on the various lines, and, optionally, a third list identifying a plurality of memories each designed to store data relating to an "(approach run-up)" performed by the buses to be caught immediately prior to reaching a selected stop, i.e., a final drive length or final driving distance and control means serving firstly to display and to scroll on the screen of the appliance successively the first list, a specially selected one of the second lists, and a third list if provided, and secondly to "confirm" within each list a reference that is selected to be taken into account, each confirmation causing the display to move on to the following list that corresponds to the selection that has been performed; and secondly, operational means suitable for displaying in succession on the screen of the appliance data relating to the various bus approach run-ups or driving distances that have previously been selected and optionally stored, which data comprises, for each run-up, visible information associated with the waiting times for the next buses expected at the stop at which said run-up terminates.

In preferred embodiments, use is also made of one or more of the following features:

the programming means comprises three control keys associated respectively with confirmation and with scrolling the lists in each of two directions, and the operational means comprise two control buttons associated respectively with renewing the display of the last run-up to be displayed, and with displaying in succession the run-ups that have been stored;

the appliance is organized in such a manner that a further press on the first control button has the effect of renewing the display of the bus approach run up terminating at a stop, as taken from the second list, and that has previously merely been confirmed without being specially stored;

the appliance includes means suitable for emitting a signal, in particular a sound signal, as soon as the waiting time for the next bus at a monitored selected stop drops below a predetermined threshold;

the appliance is in the form of a flat rectangular parallelepiped having rounded edges and easily holdable in one hand, being organized in such a manner that when held in the hand it is easy to use the thumb of the hand concerned to actuate the buttons for controlling the display of stored run-ups while also allowing the user to see clearly the data displayed on the screen relating to said stored run-ups;

the three sides of the rectangular parallelepiped defining said appliance have sizes lying respectively in the following ranges: 5 cm to 6 cm, 8 cm to 9 cm, and 0.5 cm to 2 cm, and the screen is in the form of a rectangle having rounded corners and occupying about 3 cm by 6 cm, which rectangle is offset towards one of the corners of the appliance, thereby leaving two broad margins adjacent to the opposite corner comprising a short margin and a long margin that together form an L-shape, the three keys being disposed side by side in the short broad margin and the two buttons for controlling the display of stored run-ups being disposed in that portion of the long broad margin that is furthest from the short broad margin; and the means for programing the appliance further includes memory means suitable for storing a fourth list specifying different times of day, means associated with control means and display means that enable the appliance To be activated or "woken up" (i.e., powered up from an inactive state) at a given future instant that is a predetermined length of time prior to the expected approximate time at which the appliance is next to be used.

In addition to the above main features, the invention also includes certain other features that are preferably used simultaneously therewith and that are explained in greater detail below.

BRIEF DESCRIPTION OF THE DRAWINGS

There follows a description of a preferred embodiment of the invention given with reference to the accompanying drawings and naturally by way of nonlimiting example.

FIG. 1 of the drawings is a perspective view of a portable appliance in accordance with the invention and shown in operation.

FIG. 2 shows the same appliance in similar manner but with a display mode that is different from that of FIG. 1.

DESCRIPTION OF THE PREFERRED EMBODIMENTS

Figure 3:
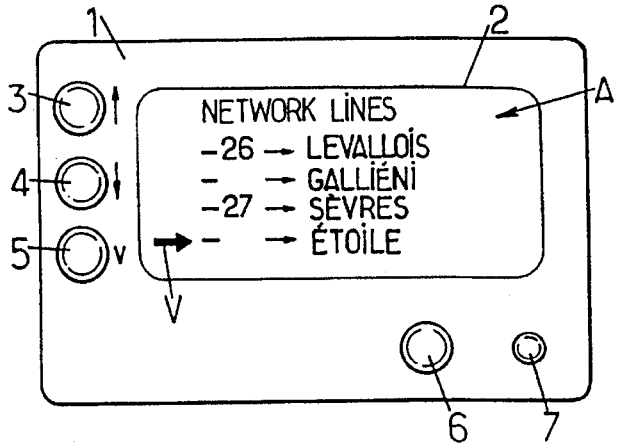
FIGS. 3 to 6 show the front face of the same appliance in four successive stages during programming.

The present invention is concerned with informing users of buses on an urban network seeking to catch such a bus at a given stop on a given line of the network about the actual waiting times for the "next buses" expected at the stop.

To this end, and as described in the above-mentioned patent, portable appliances are provided that are made available to users and that are suitable for cooperating with an installation that is designed to generate and transmit signals cyclically over an electromagnetic path, the signals providing information about the actual instantaneous positions of the respective buses of the network. These appliances include an electrical power supply, user-actuatable interrogation means suitable for identifying a desired stop, means suitable for receiving the above-mentioned signals and for selecting those of said signals that relate at least to the "next bus" expected at the identified stop, and means suitable for displaying on the appliance information relating to waiting times for said next bus at said stop.

The above-mentioned signal transmission installation and the reception and selection means associated therewith in the appliance do not directly form part of the present invention (which relates more specifically to the appliance itself and to its display means): that is why they are represented diagrammatically in FIGS. 1 and 2 by an arrow F and are not described herein.

The appliance given reference 1 is of a shape and size suitable for enabling it to be held easily in one hand, and it has a video screen 2 on which a certain amount of information can be displayed, as described below.

The appliance also comprises:

- three keys 3, 4, and 5 used for "programing" the appliance, i.e. for storing a certain number of selected bus "approach run-ups" as described above where each "approach run-up" (referred to below more briefly as a "run-up") or driving distance is associated with a departure stop selected by the user and corresponding to the route followed by the bus in question immediately upstream from that stop, in other words, the user stores the final driving distances for a bus upstram from the stop in question.
- a button 6 for activating or "waking up" the appliance causing it to display on its screen 2 that one of the previously stored run-ups which has been displayed most recently; and
- a button 7 which may be provided in a form that differs from the button 6 so as to make it easy to distinguish therefrom, e.g. by being smaller than the button 6, such that successive presses on the button 7 provides for stepping successively through displays of the various run-ups stored in the appliance.

Figure 7:
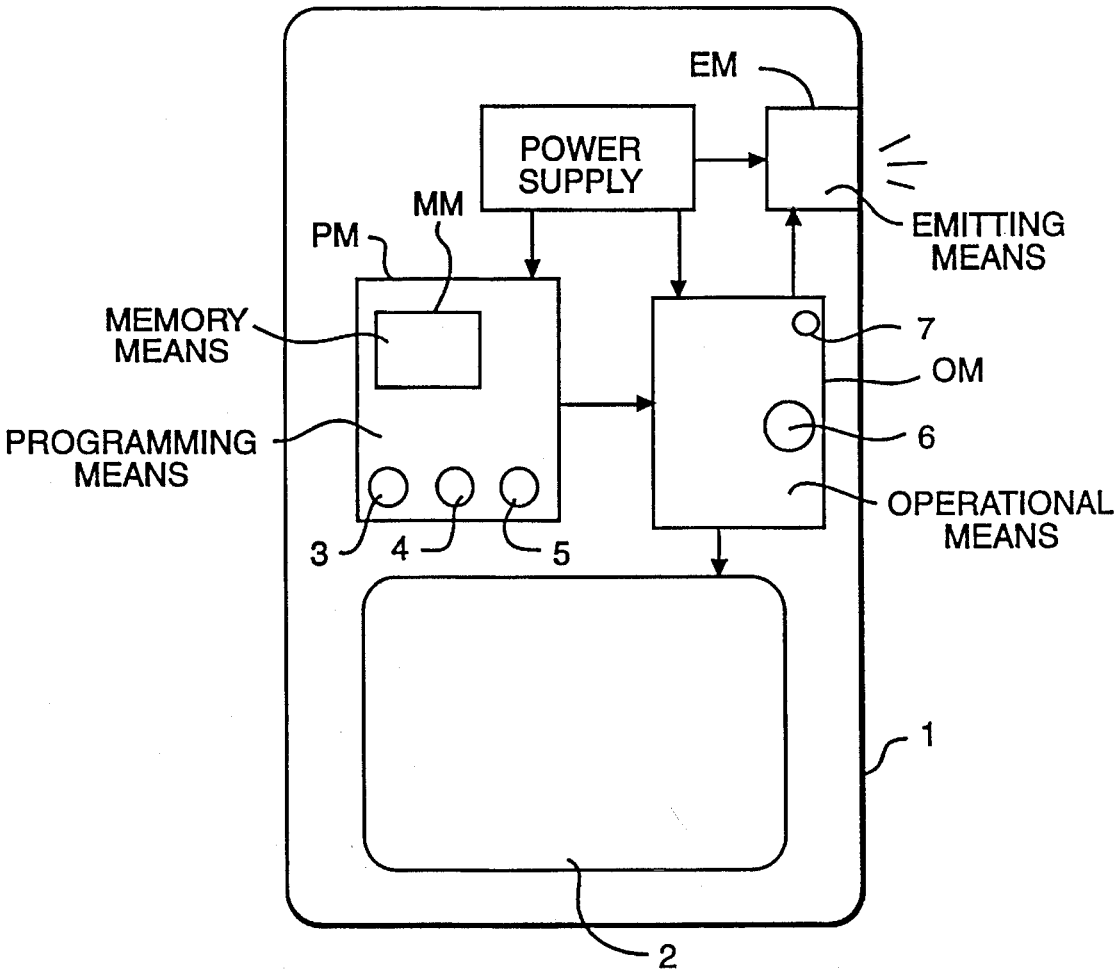

Buttons 6 and 7 control an operational means OM as indicated in FIG. 7, while a power supply for appliance 1 is indicated at PS.

The term "wake up" as applied to the appliance means that electrical power is applied thereto after a period of "sleep" or "de-excitation" (deactivation) thereof. Such a period may be initiated automatically whenever a given display has been on for e predetermined threshold duration, e.g. of the order of 1 minute.

Like the button 6, the button 7 and each of the three keys 3, 4, and 5 can be designed to "wake up" the appliance.

Figure 4:
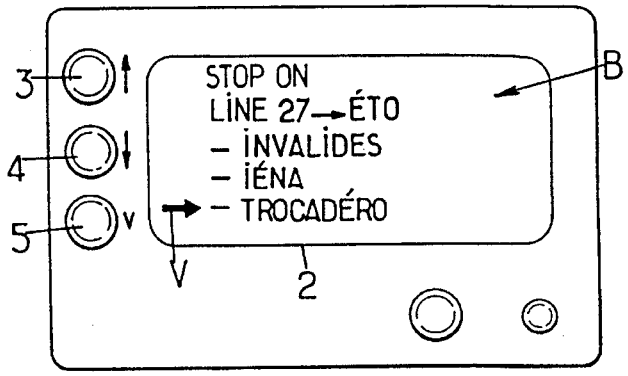
Figure 5:
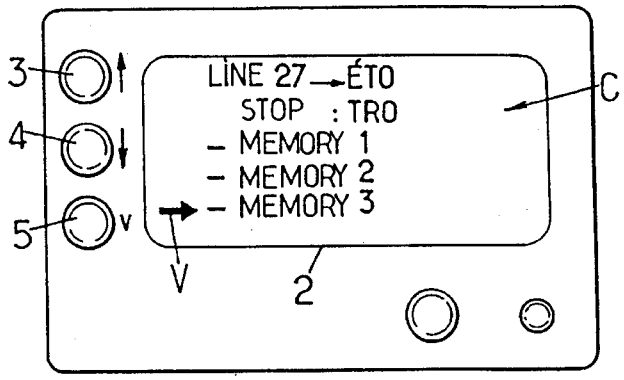

As shown in FIG. 7, programming of the appliance 1 makes use of a programming means PM including a memory means suitable for storing:

- a first list (shown at A, FIG. 3) of the various lines in the network, together with their destinations or depots, each of the "lines" in the list corresponding to a particular travel direction of the buses;
- a plurality of second lists (shown at B, FIG. 4) showing the various stops on the various lines; and
- a third list (shown at C, FIG. 5) identifying various memories 1, 2, 3, . . . , each suitable for storing or memorizing a particular one of the approach "run-ups" or final driving distances of buses as defined above.

Said programming also makes use of the three above-mentioned keys 3, 4, and 5 which have the following functions respectively:

- whenever a list (A, B, or C) is displayed on the screen 2, each press on the key 3 causes said list to scroll continuously or discontinuously in one direction, while each press on the key 4 causes the same list to scroll in the opposite direction; and
- pressing the key 5 serves to confirm an item selected in the displayed list and to cause the following list to be displayed, which following list corresponds the selection that has been confirmed.

The selection leading to the above confirmation may be displayed in any appropriate manner, e.g. by putting an arrow V as shown in position facing the selected item, or by causing the sole item in the list that is selectable to be displayed in what might be referred to as "reverse video" so that the corresponding characters are displayed pale on a dark background whereas the other characters are displayed dark on a pale background, or vice versa, etc.

To understand clearly how the appliance as described above operates, there follows a more detailed explanation of said operation.

Assume that a user desires to take one of the buses travelling on line 27 from a departure depot SEVRES to an arrival terminus ÉTOILE, and that the stop on line 27 at which the user wishes to catch the bus is TROCADÉRO.

To this end, the user begins by causing a portion of the list A of network lines to be displayed on the screen 2 by pressing a sufficient number of times on the confirmation key 5.

Thereafter, by pressing on the keys 3 or 4 as appropriate, the list A is scrolled until the legend or indication "27→ ÉTOILE" is in the position where it can be confirmed, i.e. is level with the arrow V.

By pressing the confirmation key 5 at this point, the display on the screen 2 switches automatically to a portion of list B showing the stops on selected line 27 going towards the arrival-terminus ÉTOILE.

Here again, by pressing one or other of the keys 3 and 4 the list B is scrolled 2 until the word "TROCADÉRO" appears level with the arrow V.

The user then presses the key 5 again, thereby causing the screen 2 to display at least a portion of list C showing the memories available in the appliance for storing the bus run-up situated immediately upstream from the stop TROCADÉRO on line 27 heading towards ÉTOILE.

Once the user has brought the number corresponding to the memory associated with said run-up to the arrow V, a further press on the key 5 completes programming of the appliance with respect to the above-defined run-up.

To use the appliance, it then suffices to press on the button 6, thereby causing the screen 2 to display the information and images that are visible in one or other of FIGS. 1 and 2 and that relate to the stored run-up which corresponds to buses travelling along line 27 towards ÉTOILE and located immediately upstream of the stop at TROCADÉRO.

The displays as shown in FIGS. 1 and 2 differ in that the FIG. 1 display is of a "vertical" type where characters to be read are on lines parallel to the short sides of the rectangular screen 2, whereas the second display of FIG. 2 is of a "horizontal" type, which makes it possible to write longer lines.

As can clearly be seen in FIGS. 1 and 2, the display shows a length of straight line 8 having graduations and terminated by a symbol 9 representative of the TROCADÉRO stop, with two symbols 10 and 11 being shown moving along the line and representing the "next buses" expected at said stop.

The graduations 14 on the length 8 may represent the stops before the TROCADÉRO stop on the line in question.

The same screen 2 also displays in plain, uncoded language waiting times for the next three buses which in this case are respectively 5, 17, and 28 minutes.

There can also be seen on the screen 2 the mention "M3" which indicates that the memory in use for this display is memory number 3 of the list C.

Several "run-ups" for buses belonging to any other stop at the network may also be stored in the manner described above and associated with various other memories 1, 2, 4, 5, etc. in the list C.

To cause these various stored run-ups to appear, it suffices merely to press one or more times on the button 7.

Thus, when a user seeks to make use of the appliance, i.e. to be informed about waiting times for the next buses expected at a selected stop in the network, it suffices to press on the button 6 if the stored run-up that has most recently been displayed corresponds to said bus stop: otherwise, it is necessary to press also on the button 7 (or on the button 7 only) until the desired stored run-up is automatically displayed.

Control of the two buttons 6 and 7 can become extremely easy, and even instinctive, using the thumb of the hand that is holding the appliance.

To this end, it is advantageous for the shape of the appliance to be such as to enable it to be held easily in the hand and such that while held in the hand:

firstly, the screen 2 is clearly visible to the user; and secondly, the buttons 6 and 7 lie substantially under the thumb of the hand that is holding the appliance.

In the embodiment shown, the appliance has the general shape of a rectangular parallelepiped with rounded corners, with its three sides having the following dimensions respectively: 5 cm to 6 cm, 8 cm to 9 cm, and 0.5 cm to 2 cm.

In addition, the screen 2 is in the form of a rectangle having rounded corners and located within one of the two large faces of the appliance, being offset towards one of the corners of said large face so as to leave two broad strips meeting in the opposite corner and forming an L-shape having a short strip 12 and a long strip 13.

The three keys 4, 5, and 6 are placed side by side in the short broad strip 12 while the two buttons 6 and 7 are located in the long broad strip 13 in that portion of said strip which is furthest from the strip 12.

In preferred embodiments, use is also made of the improvement described below.

In certain cases, working out the waiting time for a bus at a given stop can require a certain amount of time, which may exceed 1 minute: that can happen, for example, when the calculation makes use of the average speed of the bus in question over a certain period of time, as taught in French patent No. 92 09043.

Under such circumstances, it may be advantageous to switch on the appliance set to display the "stored run-up" terminating at the stop where the user wants to catch a bus for a certain length of time prior to the instant at which the user will really want to find out about the waiting times for said run-up.

In order to avoid wasting the power supply, it is also appropriate for such operation not to be continuous.

To this end, a fourth prerecorded list D is added to the three lists A, B, and C mentioned above. The list D shows in plain, uncoded language a list of times of day covering a full day, which list may be split up into hours and half-hours.

When at least a portion of the list D is displayed by pressing the key 5 while displaying the preceding list C, pressing the keys 3 and 4 then has the effect of causing the list D to scroll on the screen 2.

When the desired time its displayed on the screen in a position where it can be confirmed, i.e. in this case adjacent to the stationary arrow V, then the effect of confirming it by pressing on the key 5 is to cause the appliance to "wake up" at future time H.

This feature makes it possible to limit the time during which the appliance is powered up to the period which is useful for calculating the waiting times to be displayed.

Figure 6:
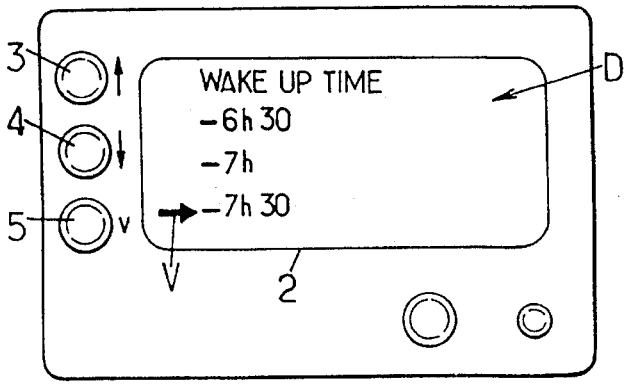

In the example shown in FIG. 6, the programmed energization "wake up" time for the appliance is 7:30 AM which corresponds, for example, to a user who expects to make use of the appliance at about 8:00 AM on a given morning: it then suffices for the user to perform the above-described confirmation during the previous evening to ensure that the appliance "wakes up" automatically half an hour before its intended use.

To reduce electricity consumption of the appliance even further, it may be organized so that on being "woken up" only those circuits that are concerned with the last-displayed memorized run-up and the corresponding functions of the appliance are powered up: in the event of such partial waking up, separate memory means that are used for programming the appliance remain "asleep".

Numerous improvements and variants of the above-described characteristics can be envisaged without going beyond the ambit of the present invention.

Two such improvements are described below.

The first improvement takes account of the fact that it is possible to display any run-up that has not previously been stored on the screen 2, with such a run-up being selected in the manner explained above by "confirming" the corresponding station in the list B pressing on the key 5.

Once such confirmation has taken place, the run-up in question in the selected direction and approach the selected stop can be displayed merely by pressing on the button 6.

In this improvement, the display can be repeated merely by pressing the button 6 again, with this continuing to be the case until a new operation is performed on the appliance.

In other words, successive presses on the button have an effect that is entirely analogous to pressing the repeat button that is to be found on many telephone keypads, with such presses having the effect of automatically repeating the last-dialled number until a new number is dialled on the telephone.

This improvement simplifies use of the appliance since the user is not required to perform the storage operation, with the down-side of such ease of use being that the above-described temporary display wall be lost as soon as the user causes some other run-up to be displayed, e.g. a memorized run-up.

A second improvement is applicable when the appliance is kept in the standby state with those circuits concerned with monitoring a given bus run-up approaching a given stop being activated for a sufficient length of time before the user actually catches a bus at that stop.

With this improvement, the appliance includes, as shown in FIG. 7, an emitting means EM for issuing an appropriate signal, preferably an audible "beep" type signal, when the waiting time for the next bus at the stop in question drops below a predetermined threshold.

Thus, for example, a user can be warned automatically when there remains no more than a predetermined length of time, e.g. 5 minutes or 10 minutes in which to catch the bus.

We claim:

1. A portable appliance for informing users of an urban bus network about waiting times for buses at various stops of the network, the appliance being associated with an installation designed to generate and transmit signals which provide information about the respective instantaneous real positions of the buses of the network, and said appliance comprising: an electrical power supply, user-actuatable interrogation means for identifying any specified stop of the network, means for receiving said signals and for selecting those of said signals which relate at least to the "next bus" expected at the identified stop, and means including a video screen for displaying on said screen information associated with the waiting time for the next bus at said stop, said appliance further comprising: (i) programming means including memory means for storing a first list in plain language of the various lines of the network together with their destinations, and a plurality of second lists in plain language of the various stops on the various lines, and control means for displaying and scrolling on said screen of the appliance the first list, and a selected one of said second lists, and for confirming, within each said list, a selected element of the list to be taken into account, each confirmation causing the display to move on to the following list that corresponds to the selection that has been performed; and (ii) operational means for displaying in succession on the screen of the appliance data relating to various final driving distances for the buses that have previously been selected, which data comprises, for each final driving distance, visible information associated with the waiting times for the next buses expected at the stop at which that final driving distance terminates.

2. A portable appliance according to claim 1, wherein the means for programming the appliance further include memory means for storing a third list identifying a plurality of memories each designed to store data relating to a final driving distance performed by the buses to be caught immediately prior to reaching a selected stop.

3. A portable appliance according to claim 2, wherein the programming means comprise three control keys associated respectively with confirmation of the lists, with scrolling said lists in a first direction and with scrolling the lists in a second, opposite direction, and wherein the operational means comprise two control buttons for controlling, respectively, renewing the display of the last final driving distance to be displayed, and displaying in succession final driving distances that have been stored.

4. A portable appliance according to claim 3, wherein a further pressing on the first control button provides a further display of the bus final driving distance terminating at a stop, as taken from the second list, and that has previously merely been confirmed without being specifically stored.

5. A portable appliance according to claim 1, wherein said operational means monitors waiting times for the selected stops and said appliance further comprises means responsive to said operational means for emitting a signal as soon as the waiting time for the next bus at a monitored selected stop drops below a predetermined threshold.

6. A portable appliance according to claim 2, wherein said appliance comprises a flat rectangular parallelepiped having rounded edges and easily holdable in one hand, and arranged such that, when held in the hand, the thumb of the hand is disposed so as to be able to actuate the buttons for controlling the display of said stored final driving distances while also allowing the user to see clearly the data displayed on the screen relating to said stored final driving distances.

7. A portable appliance according to claim 6, wherein the three sides of said rectangular parallelepiped have sizes lying, respectively, within the following ranges: 5 cm to 6 cm, 8 cm to 9 cm, and 0.5 cm to 2 cm, and wherein the screen comprises a rectangle having rounded corners and occupying about 3 cm by 6 cm, said rectangle being offset towards one of the corners of the appliance, thereby leaving two broad margins adjacent to the opposite corner, said margins comprising a short margin and a long margin that together form an L-shape, said three keys being disposed side by side in the short broad margin and the two buttons for controlling the display of stored driving distance being disposed in that portion of the long broad margin that is furthest from the short broad margin.

8. A portable appliance according to claim 1, wherein the means for programming the appliance further includes memory means for storing a fourth list specifying different times of day, and means for enabling the appliance to be energized from an unpowered state at a given future instant that is a predetermined length of time prior to the expected approximate time at which the appliance is next to be used.

* * * * *